US006570113B2

(12) United States Patent
Yu et al.

(10) Patent No.: US 6,570,113 B2
(45) Date of Patent: May 27, 2003

(54) KEY SWITCH

(75) Inventors: Ching-Chiang Yu, Keelung (TW); Yong Te Tsao, Taipei (TW)

(73) Assignee: Behavior Tech Computer Corporation, Taipei (TW)

( * ) Notice: Subject to any disclaimer, the term of this patent is extended or adjusted under 35 U.S.C. 154(b) by 0 days.

(21) Appl. No.: 09/925,459

(22) Filed: Aug. 10, 2001

(65) Prior Publication Data

US 2003/0029708 A1 Feb. 13, 2003

(51) Int. Cl.[7] ..... H01H 3/12
(52) U.S. Cl. ..... 200/344
(58) Field of Search ..... 200/344, 409

(56) References Cited

U.S. PATENT DOCUMENTS 3,624,332 A * 11/1971 Van Benschoten et al. ..... 200/409 X
5,488,210 A * 1/1996 Shigetaka et al. ..... 200/344
5,562,203 A * 10/1996 Mochizuki ..... 200/344
6,150,624 A * 11/2000 Yao ..... 200/344

* cited by examiner

*Primary Examiner*—Renee Luebke
(74) *Attorney, Agent, or Firm*—Rosenberg, Klein & Lee

(57) ABSTRACT

A key switch apparatus is provided. The key switch apparatus includes a key base, a key cap, and a collapsible linking assembly extending between the key cap and the key base. The linking assembly is reconfigurable between extended and collapsed positions for displaceably supporting the key cap relative to the key base. The linking assembly includes pivotally coupled first and second linking members. The first linking member is provided with a flexible member that is resiliently biased to bulge transversely outward toward the key cap when the linking assembly is disposed in the extended position. The second linking member is formed with a press member that maintains contact with the flexible member, such that it transversely deflects the flexible member inward toward the key base responsive to the application of a pressing force upon the key cap. The second linking member is biased by the flexible member to restore the linking assembly to its extended position upon removal of the pressing force from the key cap.

5 Claims, 3 Drawing Sheets

KEY SWITCH

BACKGROUND OF THE INVENTION

1. Field of the Invention

The present invention relates to a key switch, especially suited for use on a keyboard for a notebook computer, employing a flexible member to produce a sense of two-step touch control, and to restore the key switch to its original position without the use of rubber components installed therein.

2. Background of the Invention

Conventional approaches to key switches for keyboards have aimed at reducing the dimensions of the key switches, so that they may be used on notebook computer keyboards. Therefore, almost all designs employ crossed linking members to transmit the pressing operation of key switches. But there should remain a detectable feeling of two-step touch control during the key switch pressing operation. Therefore, connecting rods or other such constructions are normally used on key switches to enable the feeling of two-step touch control, but they are normally too sophisticated to enable convenient assembly.

Furthermore, for smooth restoration to the original position after the pressing force applied on the key switch is removed, normally there is a rubber component installed in the key switch, the rubber component serving to provide the resilience required to restore the key switch to its original position. For the purpose of providing the feeling of two-step touch control and restoring the key switch to its normal position, then, sophisticated construction is required, leading to increased man hours and difficulty of labor in the assembly process, as well as to increased costs.

SUMMARY OF THE INVENTION

The primary object of the present invention is to provide a key switch comprising a key base, a key cap, a first linking member and a second linking member that cross and inter-link with each other, and a flexible member that is installed on the first linking member. The second linking member has a pressing member that maintains contact with the flexible member. When the key switch is pressed down, the pressing lever depresses the flexible member downward, causing the flexible member to change its shape from an outward curve to a straight line, then to an inward curve, producing the feeling of two degrees of resistive force. When the pressing force is removed, the resilience of the flexible member drives the key switch upward to restore its original, normal position.

Because the flexible member is employed on the key switch to produce the feeling of two-step touch control and restore the key switch to its original position, the need for installation of any rubber component, or for a sophisticated construction is eliminated. This leads to reduced production costs, simplified assembly processes, and extended service life.

BRIEF DESCRIPTION OF THE DRAWINGS

The drawings of the preferred embodiments of this invention are described below to enable better understanding, wherein.

DETAILED DESCRIPTION OF THE PREFERRED EMBODIMENTS

Figure 1:
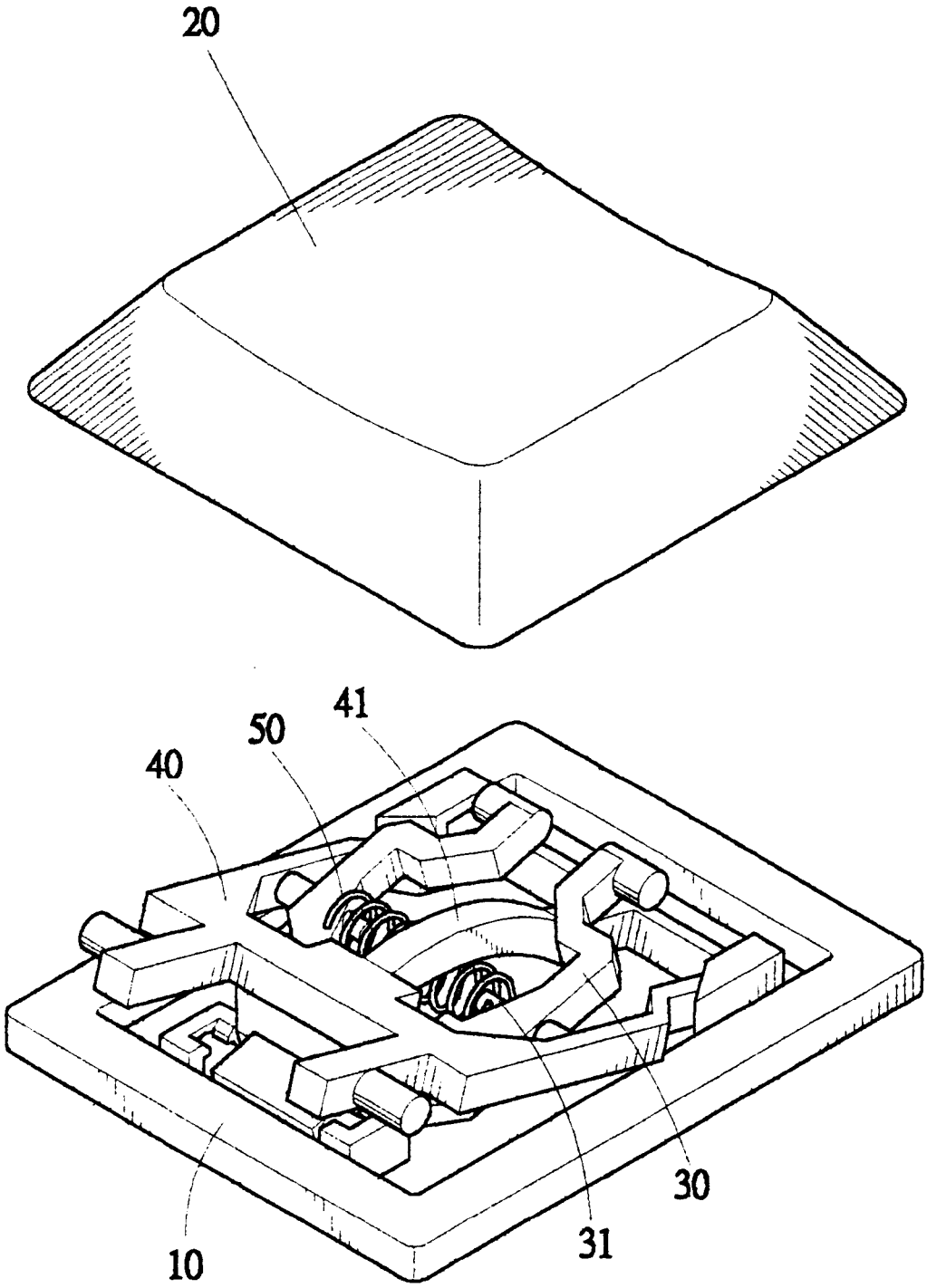
FIG. 1 is a perspective view of the key switch of the present invention, with only the key cap disassembled.
Figure 2:
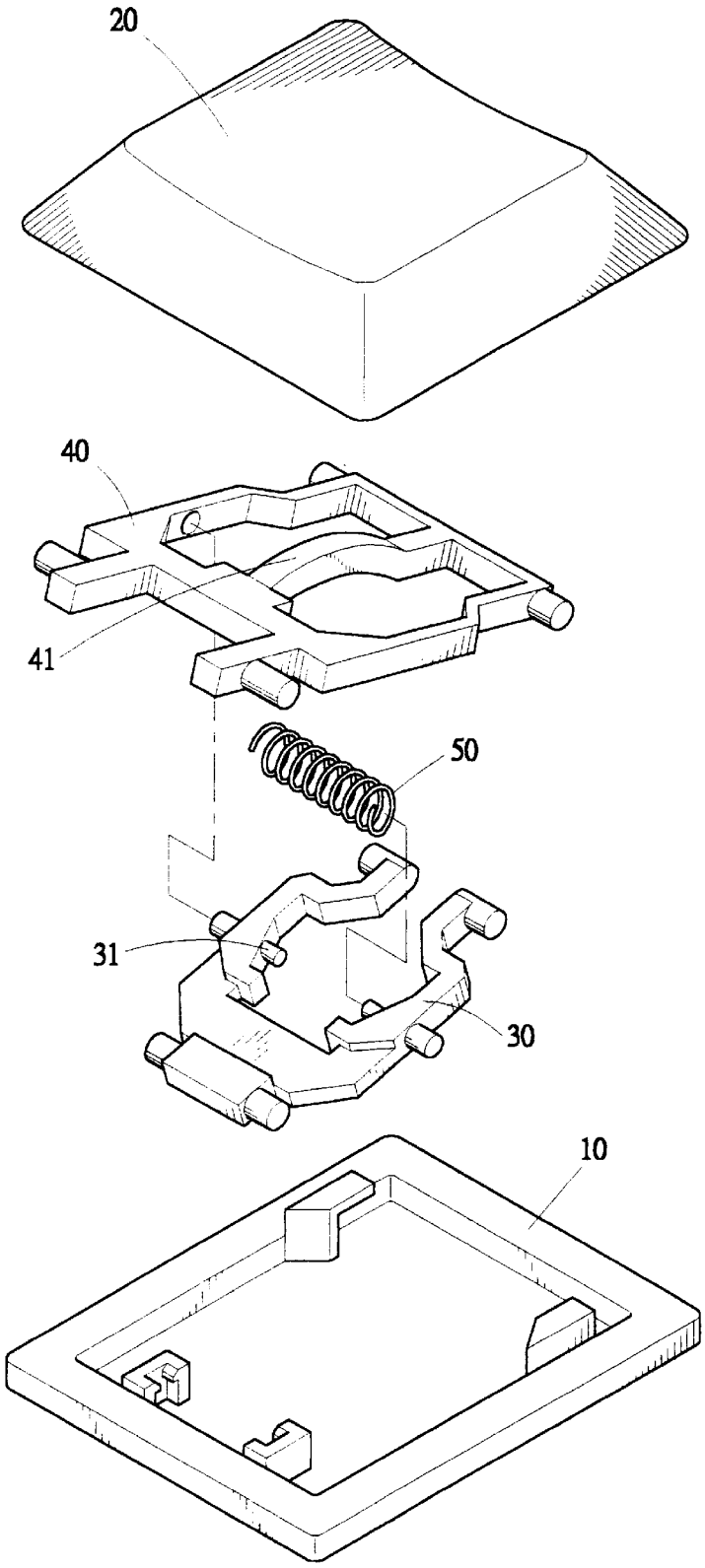
FIG. 2 is an exploded view of the key switch of the present invention.

As shown in FIGS. 1 and 2, the key switch of the present invention comprises a key base 10, a key cap 20, a first linking member 30, and a second linking member 40. The first and second linking members 30, 40, cross and inter-link one with the other, and are installed between the key base 10 and the key cap 20.

A flexible member 50, in the form of a spring, is installed on the first linking member 30. The first linking member 30 has fixing pins 31, onto which the flexible member 50 can be mounted. The flexible member 50 is configured and disposed such that when normally positioned, it is compressed and biased to curve outward as shown. The second linking member 40 has a pressing member 41 that maintains contact with the flexible member 50.

Figure 3:
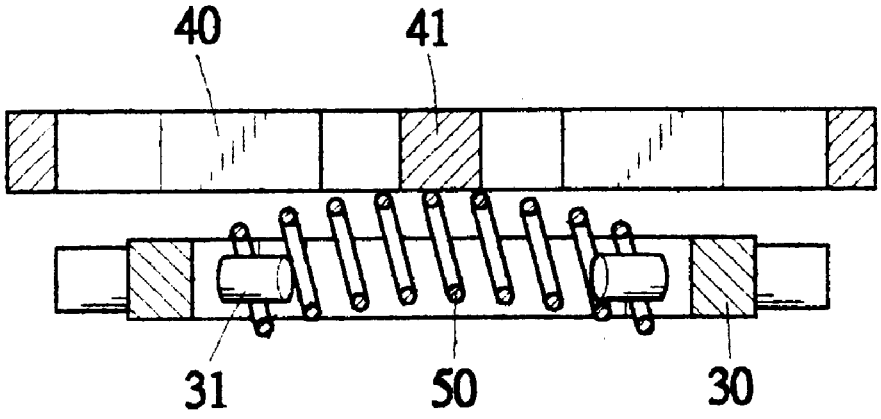
FIGS. 3 and 4 are cross-sectional views showing the key switch of the present invention in different stages of operation.
Figure 4:
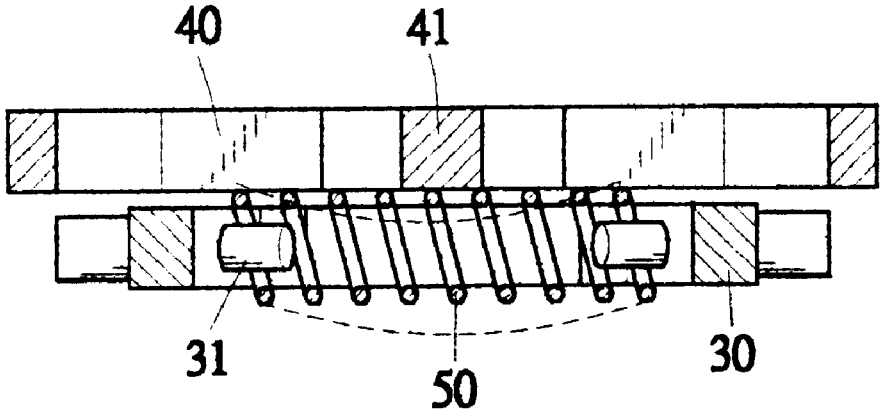

Referring to FIGS. 3 and 4, when the key cap 20 is pressed down, the pressing member 41 of the second linking member 40 depresses the flexible member 50, so that the flexible member 50 is deflected from its outwardly curved axial extension to compress to a substantially straight axial extension, then further to an inwardly curved axial extension, creating for the user a sense of two-step touch control. When the pressing force is removed, the resilient force of the flexible member 50 pushes the second linking member 40 upward. The second linking member 40 in turn drives the key cap 20 upward, drawing the first linking member 30 accordingly, so as to restore the key cap 20 to its original rest position.

What is claimed is:

1. A key switch apparatus comprising:

(a) a key base;

(b) a key cap; and, (c) a collapsible linking assembly extending between said key cap and key base, said linking assembly being reconfigurable between extended and collapsed positions for displaceably supporting said key cap relative to said key base, said linking assembly including:

first and second linking members pivotally coupled for angular displacement one relative to the other, said first linking member having a pair of spaced fixing portions and a flexible member captured to extend axially therebetween, said flexible member being resiliently biased to bulge transversely outward toward said key cap when said linking assembly is disposed in said extended position;

said second linking member having a press member disposed to maintain engagement of said flexible member, said second linking member being displaceable to transversely deflect said flexible member inward toward said key base responsive to application of a pressing force upon said key cap, said second linking member thereby forcing a responsive angular displacement of said first linking member relative thereto, said second linking member being biased by said flexible member to restore said linking assembly to said extended position upon removal of the pressing force from said key cap.

2. The key switch apparatus as recited in claim 1 wherein said flexible member includes a spring.

3. The key switch apparatus as recited in claim 1 wherein said fixing portions of said first linking member each include a pin projecting therefrom to coaxially engage said flexible member.

4. The key switch apparatus as recited in claim 1 wherein said flexible member is resiliently deflected to bulge transversely inward toward said key base when said linking assembly is disposed in said collapsed position.

5. The key switch apparatus as recited in claim 4 wherein said flexible member is deflected substantially to an axially straight configuration at an intermediate position of said linking assembly between said extended and collapsed positions thereof.

* * * * *